US005468262A

United States Patent [19]

Acker et al.

[11] Patent Number: 5,468,262

[45] Date of Patent: Nov. 21, 1995

[54] THERMAL STABILITY ADDITIVES FOR JET FUELS

[75] Inventors: William P. Acker, Wappingers Falls; Robert T. Hahn, Beacon; Thomas J. Mach, Port Jervis; Rodney L. Sung, Fishkill, all of N.Y.

[73] Assignee: Texaco Inc., White Plains, N.Y.

[21] Appl. No.: 47,529

[22] Filed: Apr. 19, 1993

[51] Int. Cl.[6] ..... C10L 1/22

[52] U.S. Cl. ..... 44/348; 44/415

[58] Field of Search ..... 44/348, 415

[56] References Cited

U.S. PATENT DOCUMENTS

| | | | |
|---|---|---|---|
| 4,501,595 | 2/1985 | Sung et al. | 44/348 |
| 4,533,361 | 8/1985 | Sung et al. | 44/348 |
| 5,030,249 | 7/1991 | Herbstman et al. | 44/348 |
| 5,039,307 | 8/1991 | Herbstman et al. | 44/348 |
| 5,266,081 | 11/1993 | Avery et al. | 44/348 |

*Primary Examiner*—Ellen M. McAvoy
*Attorney, Agent, or Firm*—George J. Darsa

[57] ABSTRACT

A liquid jet fuel composition comprising:

(a) a major portion of a liquid fuel; and (b) a minor effective portion of a thermal stabilizing additive prepared by (i) reacting a polyamine, an aldehyde and a phenol containing active hydrogen to form a phenol - aldehyde - amine condensate; and (ii) reacting said phenol - aldehyde - amine condensate and a succinic acid anhydride bearing a polyolefin - derived substituent containing residual unsaturation, thereby forming a phenol - aldehyde amine Mannich condensate polyamine succinimide product additive; and (iii) recovering said product additive.

8 Claims, 3 Drawing Sheets

THERMAL STABILITY ADDITIVES FOR JET FUELS

BACKGROUND OF THE INVENTION

This invention relates to jet fuels, and more particularly to thermal stability additives for jet fuels.

The thermal stability of jet fuel has been recognized as a problem for many years. High speed flight necessitates that the heat generated be dissipated through the fuel, i.e., the fuel is purposely preheated prior to combustion. As aircraft have become more sophisticated with more electronic components, the heat load has increased and the fuel must be preheated to a higher temperature to absorb the energy. This makes the thermal stability of the fuel even more critical. The chemistry leading to particulate and deposit formation is extremely complex and very difficult to provide thermal stability of jet fuels. Thus, an object of the present invention is to provide an effective thermal stabilizing additives for jet fuels.

DISCLOSURE STATEMENT

U.S. Pat. No. 4,501,595 discloses that diesel oil of improved storage stability contains condensate of tetraethylenepentamine; paraformaldehyde; 2,6-di-t- butyl phenol; and polyisobutenyl succinic acid anhydride.

U.S. Pat. No. 4,233,035 discloses that additives are organic compounds which are capable of chelating metals and may be used to improve the high-temperature thermal stability of hydrocarbon fuels, especially aviation fuels.

Since there is a lack of stabilizing additives, the object of these present invention is to provide an effective stabilizing additive for jet fuels.

SUMMARY OF THE INVENTION

This invention provides a liquid jet fuel composition comprising:

(a) a major portion of a liquid middle distillate hydrocarbon fuel; and (b) a minor effective portion of a thermal stabilizing additive prepared by (i) reacting a polyamine, an aldehyde and a phenol containing active hydrogen to form a phenol - aldehyde - amine condensate;

(ii) reacting said phenol - aldehyde - amine condensate with a succinic acid anhydride bearing a polyolefin - derived substituent containing residual unsaturation, thereby forming a phenol - aldehyde - amine Mannich condensate polyamine succinimide product additive; and (iii) recovering said product additive

DRAWINGS

In order to illustrate the present invention, the following drawings are provided, where:

DETAILED DESCRIPTION OF THE INVENTION

Figure 1:
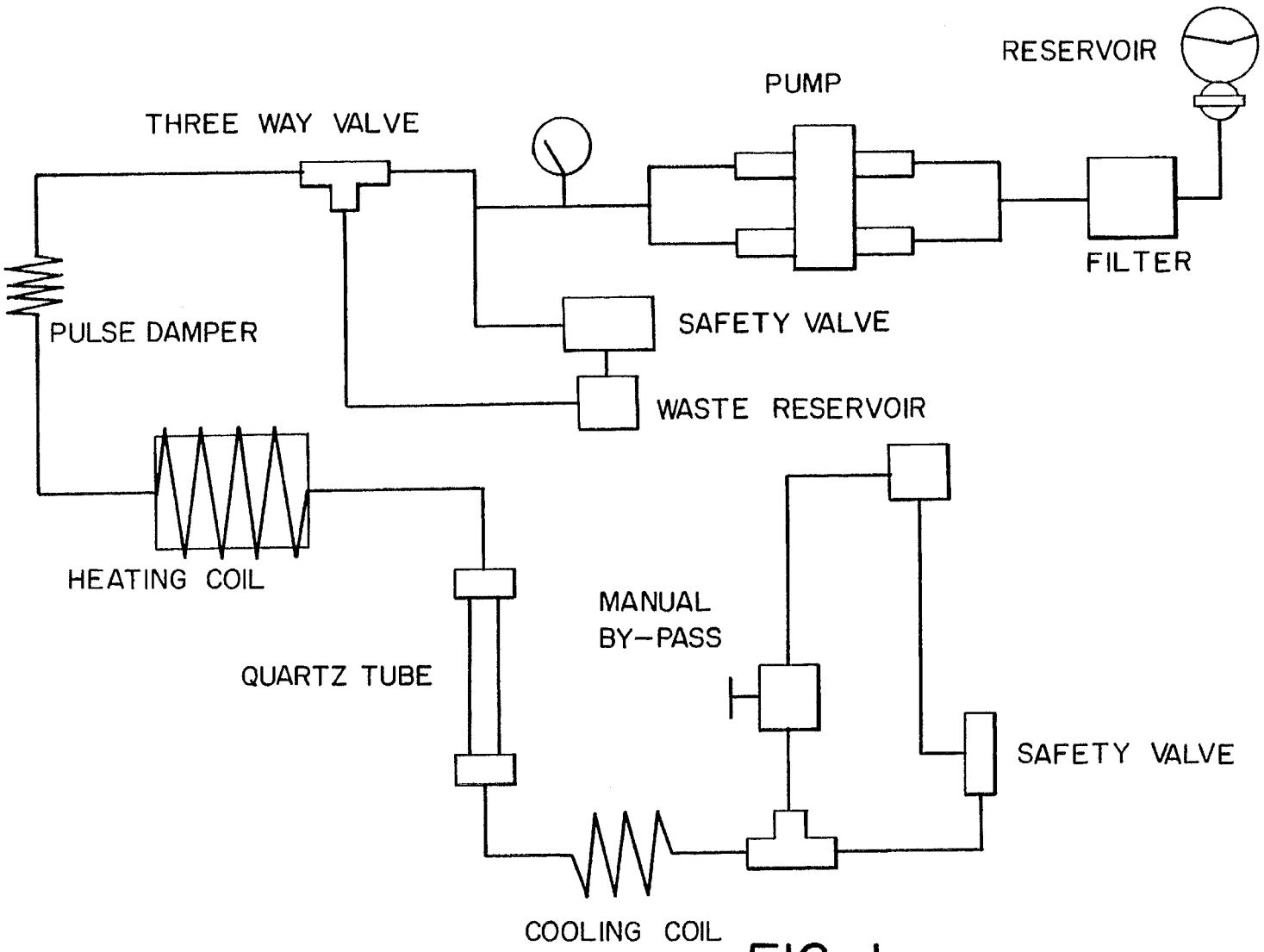
FIG. 1 is a schematic of the laser light scattering technique of the present additive.

Thermal stability of jet fuel has been recognized as a problem for many years. In future aircraft, higher speed flight and an increased number of electronic components to be cooled will cause the high temperature stability of the fuel to be even more critical. The detailed chemical reactions leading to particulate and deposit formation are extremely complex.

Recently, a number of efforts have been made to develop global chemistry models for the thermal decomposition of jet fuel and the subsequent deposit formation. The modeling attempts have illuminated the need for new incisive experiments such as the use of laser diagnostics and modern analytical chemistry techniques. A number of optical diagnostic techniques, including absorption, scattering, and fluorescence have been suggested as complimentary ways of evaluating jet fuel.

According to the present invention, a light scattering and laser-induced fluorescence technique are used on thermally stressed jet fuel and an additized version of the same fuel.

The Jet Fuel Thermal Oxidation Tester (JFTOT) described by ASTM D-3241 is the industry standard qualification test for the thermal stability of aviation fuel. In the JFTOT test, an aluminum tube is electrically heated and exposed to a continuous flow (3.0 ml/min) of fuel. A concentric larger tube, around the first tube, limits the volume of the fuel in the heated region. Because the fuel is continuously flowing, this limits the time during which the fuel is thermally stressed and in contact with the metal test element. Following the heated tube section, the fuel flows through a 17 μm porosity precision filter. Typically the aluminum tube is heated to 260° C. and the test duration is 2.5 hours. During a test, deposits form on the aluminum tube and particulates formed in the fuel are trapped by the filter causing an increased pressure drop across the filter. Fuel performance is determined by measuring the pressure drop across the filter during the test and by visually assessing the deposits formed on the tube after the completion of the test.

Although the JFTOT serves well as a fuel qualifying test, as a research apparatus it suffers from a number of limitations. Particularly, the subjective nature of the visual assessment of the deposit, the effect of tube surface metallurgy, and it's ability to simulate the physical conditions found in aircraft fuel systems. Metal deactivators are effective in decreasing the visual deposit formation, but may have a minimal affect on the degradation of the fuel. Because of the complexity of the problem, and the limitations of various means of testing and providing thermal stability of aviation fuels, e.g., jet fuels, the present technique has been used in evaluating the thermal stabilizing of the present additive in jet fuels.

The present additive is the reaction product of polyisobutenyl (molecular weight 1200) succinimide of polyalkylene polyamine, i.e., pentaethylene pentamine, detraethylene tetramine, or pentaethylene hexamine, a($C_2$–$C_6$) alkylphenol and formaldehyde when used to additize the jet fuel at 0.2 wt % was found to increase the thermal stability of the jet fuel vs. the fuel additized with a similar chemical, a reaction product of polyisobutenyl (molecular weight 1200) succinimide of polyalkylene polyamine which is ineffective as a thermal stability additive.

The alkylphenol that may be used in the present invention include:

2,6 - di - t - butyl phenol beta - naphthol resorcinol bis - 4,4 -(2,6 - di - t - butyl phenol)

methanecatechol

The aldehydes that may be used include:

formaldehyde ethanal propanal

The jet fuels which may be employed in the present process may typically include those having an ibp of 300° F.–430° F., say 400° F., a 50% bp of 430° F.–600° F., say 517° F., a 90% bp of 500° F.–650° F., say 597° F. and API Gravity of 30–40, say 35.2. These fuels may commonly be labeled kerosene, fuel oil, diesel oil, No. 1 Diesel fuel, No. 2 Diesel fuel. One preferred middle distillate may be a jet fuel having the following properties listed below:

| Property | Value |
|---|---|
| API Gravity | 35.2 |
| Kin. Vis. 100° F., cs | 2.86 |
| Distillation (°F.) | |
| IBP | 400 |
| 50% | 517 |
| 90% | 597 |
| EP | 628 |

The present additive is a reaction product of polyisobutenyl (molecular weight 1200) succinimide of polyalkylene polyamine, i.e., pentaethylene pentamine, detraethylene tetramine, or pentaethylene hexamine, a ($C_1$–$C_6$) alkylphenol and formaldehyde when used to additize the jet fuel at 0.2 wt % was found to increase the thermal stability of the jet fuel vs. the fuel additized with a similar chemical, a reaction product of polyisobutenyl (molecular weight 1200) succinimide of polyalkylene polyamine which is ineffective as a thermal stability additive.

The synthesis of the additive is as described below:

| Reactant | Grams | Moles |
|---|---|---|
| 1. Pentaethylene hexamine | 43.4 | 0.167 |
| 2. 2,6 di-t-butyl phenol | 34.3 | 0.167 |
| 3. Formaldehyde | 8.0 | 0.250 |
| 4. 100E Pale Stock HF polyisobutenylsuccinic anhydride sap. #51.9 | 371 | |
| 5. 5.9 wt % diluent oil | 400 | 0.185 |
| 6. Silicone oil anti-foamant (1 ml) | | |

The reaction sequence is as follows:

Reactants 2–5 are added to a reaction vessel under a nitrogen blanket. The amine is then added with stirring and the mixture is heated to 110°–140° C. for one to three hours depending on the amine. Azeotrope off water.

According to the invention the additive is present in the jet fuel in an amount ranging from about 0.02 to about 2.0 wt. % and preferably in an amount about 0.2 wt %.

In order to show the advantages of the present invention, the following example is provided.

EXAMPLE 1

Because the present invention is intended to stabilize jet fuel to a temperature much higher than those used in the standard JFTOT test, a laser light scattering technique was used to evaluate the additive. FIG. 1 shows a schematic of the experiment. High pressure fuel (450 psi) was pumped through a heater and then through a quartz observation cell. The retention time in the heater was approximately 30 seconds. During an experiment, the temperature of the fuel was increased over time and the formation of particulates was monitored by elastic scattering from an argon ion laser. As particulates form in the fuel, the side-scattered signal intensity increases. Referring to FIG. 1 where the present testing apparatus is schematically shown, a glass 500 ml reservoir supplies fuel to a adjustable flow rate, high pressure pump made of 316 stainless steel and sapphire. The pump is a dual piston design to reduce pressure fluctuations; however, to further dampen pulsations, a surge suppression coil was installed downstream from the pump. This design was chosen instead of a gas pressurized system to avoid having the bulk reservoir at high pressure and to provide easily adjustable flow rates. The high pressure region of the apparatus is entirely 316 stainless steel, with the exception of the quartz optical cell. The fuel passes by an adjustable high pressure safety valve which is set to open at 450 psi and then enters the heating unit. The heater is composed of a helical stainless steel tube wrapped around an electrically heated core. Thick insulation covers the entire heater assembly and a thermocouple measures the wall temperature of the tubing. A vertically oriented quartz tube provides optical access to the thermally stressed fuel. The temperature of the fuel exiting the quartz tube is monitored by a second thermocouple. In order to minimize the temperature gradient across the optical tube, part of the quartz and the transition piece between the heater unit and the quartz is wrapped with nichrome wire and insulated. Without the second heat source, the thermal gradients are sufficiently severe to cause a deflection of the incident laser beam which changed with fuel flow rate and temperature. With this arrangement, the fuel temperature exiting the optical tube is insensitive to the fuel flows used in the experiment.

The operating pressure of the system was controlled by an adjustable pressure release valve. Before reaching the discharge valve and reservoir, the fuel was cooled in a water heat exchanger. The pressure control valve is set to bleed off pressure at 400 psi. Because the response time of the valve is much faster than the pumping flow rate, the pressure fluctuation was less than 25 psi. During the experiment, the pressure was measured before the heater and optical cell assembly so that any severe constrictions due to deposit formation would be detected. Most of the data presented in this work was taken with a fuel flow rate of 5 ml/min which corresponds to a retention time of ≈1 sec in the optical cell and ≈30 sec in the heater.

A 488 nm line of an argon ion laser is used to illuminate the optical cell with vertically polarized light. An acousto-optic modulator intensity modulates the incident laser beam between 0 and 200 mW at a frequency of 100 hz with a 50% duty cycle. A 20 cm focal length lens was used to focus the incident beam to a diameter of <300 μm across the 2 mm inner diameter of the quartz tube which forms the scattering volume. The transmitted light was recollimated by a second lens, attenuated, and focused onto a photodiode. The side-scattered light was collected by an f/2.0 lens and focused onto an aperture to reject the light scattered from the quartz/air and quartz/fuel interfaces. The signal is detected using a large area photodiode (Hamamatsu S1723-05). All data were recorded as the difference between the peak signal and the background baseline provided by the laser modulation. Four side-scatter geometry measurements were made at each temperature point: (1) the total side scatter collected by the imaging optics (75°<q<105°); (2) the vertically polarized component; (3) the horizontally polarized component; and (4) the fluorescence passed by a 550 nm long-pass filter.

Each fuel sample was prepared in accordance with the standard JFTOT procedure in which it is aerated for 6 min. with an air flow of 1.5 L/min. and filtered. In a typical test, the fuel in the reservoir was pumped through the apparatus at 5.0 ml/min. and the heaters are activated. Data was acquired at one or two minute intervals for the test duration of 20 min.

The results of the testing described above and as illustrated in FIGS. 2 and 3 are provided below.

TESTING RESULTS

Figure 2:
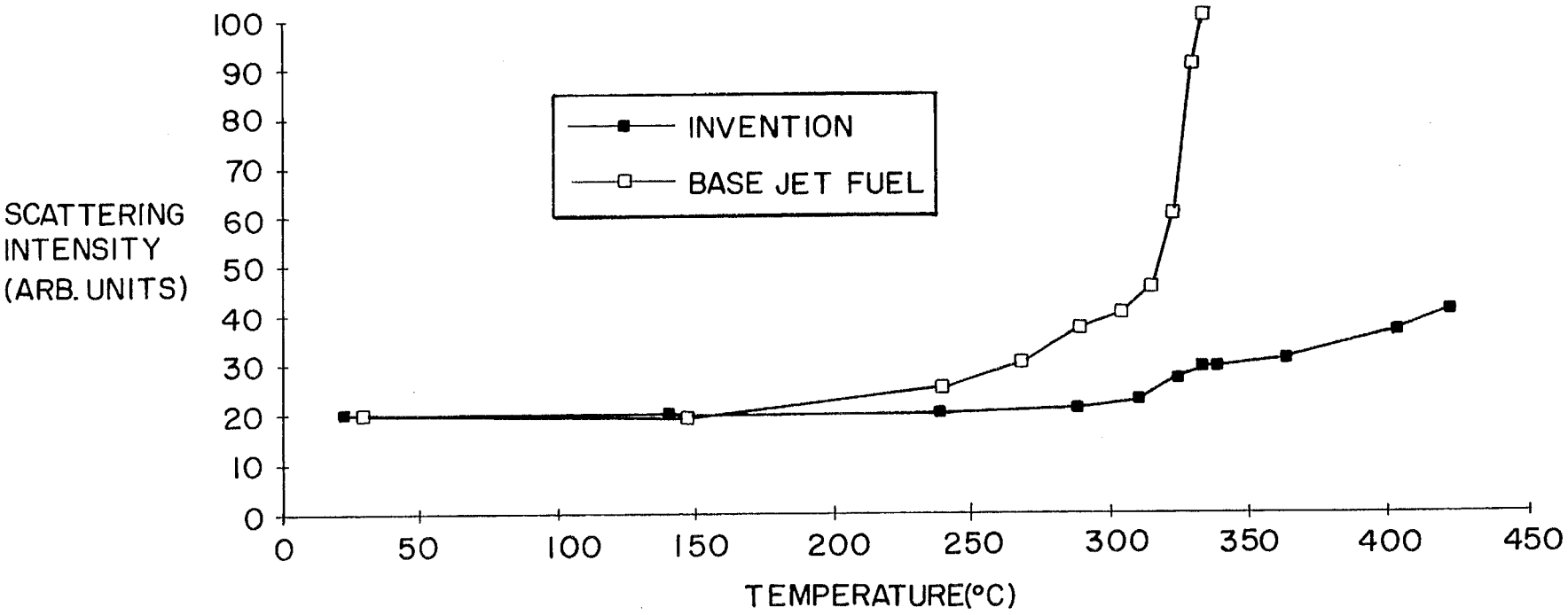
FIG. 2 shows the elastic scattering intensity as a function of temperature for both a base jet fuel and the same jet fuel additized with the present additive.
Figure 3:
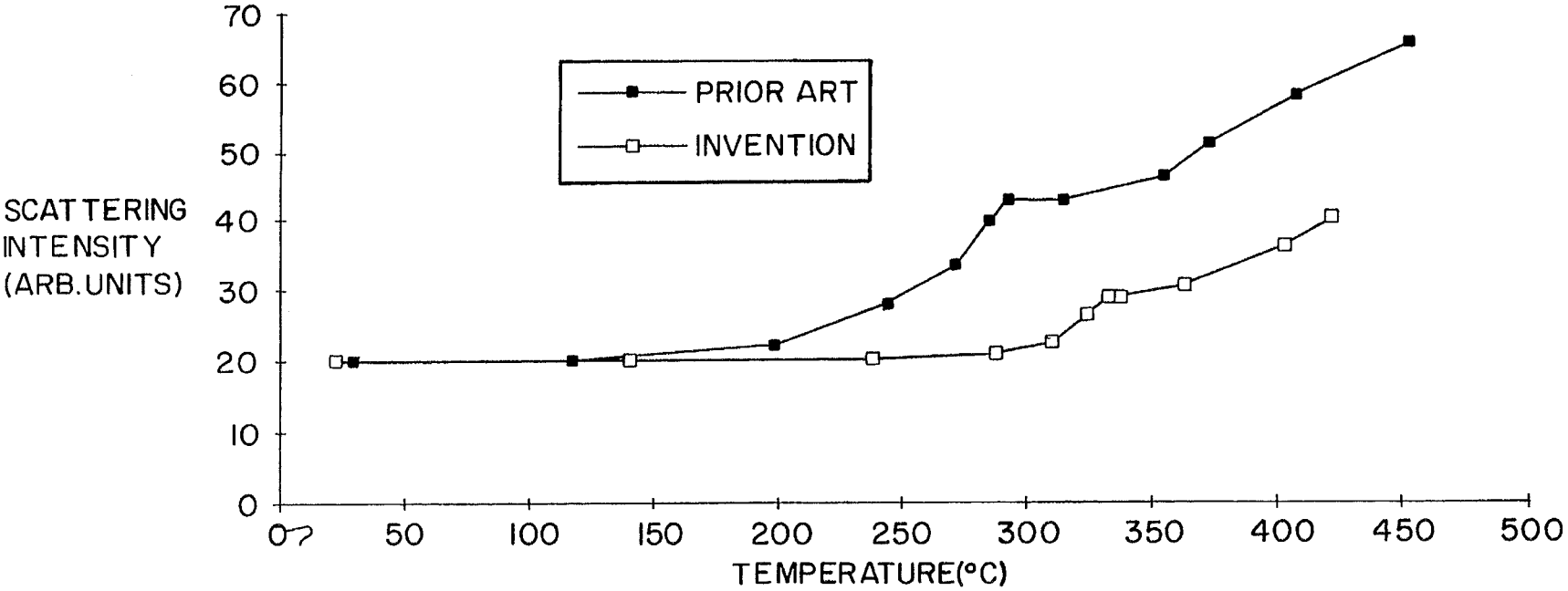
FIG. 3 shows the elastic scattering intensity detected for a jet fuel additized with the present additive and the same jet fuel additized with a prior art additive.

FIG. 2 shows the elastic scattering intensity detected orthogonally to the incident laser as a function of time for a base fuel and an additized version of the same fuel. As shown in FIG. 2, below 250° C. the scattering intensity was weak and insensitive to temperature. This baseline level of scattering intensity was due to density fluctuation with the liquid and particles which survived the pretreatment of the fuel. As the temperature was increased above 250° C., the scattering intensity from the base fuel sample increases. At ≈315° C. the scattering intensity rapidly increases. For the additized fuel, the scattering intensity does not increase until ≈300° C. and at temperatures above 340° C. the rate of increased scattering with temperature was reduced. Both the magnitude of the scattering intensity and its rate of increase with temperature is less for the additized fuel at high temperature. Both of these fuels passed a 260° C. JFTOT with an indistinguishable difference in deposit formation. The pressure drop across the JFTOT filter was slightly greater for the additized fuel at 260° C. but in both cases it was less than 3 mm of Hg. At a temperature of 260° C. the difference in elastic scattering was negligible for the two fuels which is consistent with the JFTOT results.

As shown by the above results and according to the present invention, an optical diagnostic apparatus was developed to study the formation of particulates in thermally stressed jet fuel. The device was used to evaluate the difference in thermal stability between a base jet fuel and an additized version. The fuel additive was shown to reduce the limiting reaction rate of particulate formation at high temperature.

We claim:

1. A thermally stable liquid jet fuel composition comprising:

(a) a major portion of a liquid fuel; and (b) a portion effective to provide thermal stability of about 0.2 to about 2.0 wt % of a thermal stabilizing additive prepared by (i) reacting a polyamine, an aldehyde and a phenol containing active hydrogen to form a phenol - aldehyde - amine condensate; and (ii) reacting said phenol - aldehyde - amine condensate and a succinic acid anhydride bearing a polyolefin - derived substituent containing residual unsaturation, thereby forming a phenol - aldehyde amine Mannich condensate polyamine succinimide product additive; and (iii) recovering said product additive.

2. The jet fuel of claim 1, wherein said polyamine is selected from the group consisting of pentaethylene pentamine, tetraethylene tetramine and pentaethylene hexamine.

3. The jet fuel of claim 1, wherein said aldehyde is selected from the group consisting of formaldehyde, ethanol and propanal.

4. The jet fuel of claim 1, wherein said additive is present in said jet fuel in an amount of about 0.2 wt %.

5. A method of thermally stabilizing a liquid jet fuel composition which has been preheated prior to combustion comprising providing a major portion of liquid jet fuel and adding thereto a thermal stabilizing effective amount of about 0.2 to about 2.0 wt % of an additive prepared by (i) reacting a polyamine, an aldehyde and a phenol containing active hydrogen to form a phenol - aldehyde - amine condensate; and (ii) reacting said phenol - aldehyde - amine condensate and a succinic acid anhydride bearing a polyolefin-derived substituent containing residual unsaturation, thereby forming a phenol - aldehyde amine Mannich condensate polyamine succinimide product additive; and (iii) recovering said product additive.

6. A method according to claim 5, wherein said polyamine is selected from the group consisting of pentaethylene pentamine, ditraethylene tetramine and pentaethylene hexamine.

7. A method according to claim 5, wherein said additive is present in said jet fuel in an amount of about 0.2 wt %.

8. A method according to claim 5, wherein said aldehyde is selected from the group consisting of formaldehyde, ethanal and propanal.

* * * * *